United States Patent [19]

Wessman

[11] 4,048,491

[45] Sept. 13, 1977

[54] RECESSED LIGHTING FIXTURE

[76] Inventor: Leonard A. Wessman, 12 Harbison Circle, Rancho Mirage, Calif. 32270

[21] Appl. No.: 640,442

[22] Filed: Dec. 15, 1975

Related U.S. Application Data

[63] Continuation of Ser. No. 458,932, April 8, 1974, abandoned.

[51] Int. Cl.[2] ..... F21S 1/02

[52] U.S. Cl. ..... 240/78 H; 240/73 BC; 248/343

[58] Field of Search ..... 240/2 U, 2 W, 41.5, 240/41.55, 78 R, 73 BC, 78 H, 78 HA, 149, 150; 248/343

[56] References Cited

U.S. PATENT DOCUMENTS

| | | | |
|---|---|---|---|
| 2,973,177 | 2/1961 | Stubbs | 240/78 H |
| 3,018,082 | 1/1962 | Berger | 240/78 H X |
| 3,018,083 | 1/1962 | Bobrick | 240/78 H X |
| 3,388,247 | 6/1968 | Rackley | 240/78 R |
| 3,755,667 | 8/1973 | Price | 240/78 R |

FOREIGN PATENT DOCUMENTS

| | | | |
|---|---|---|---|
| 226,819 | 4/1963 | Austria | 240/78 H |
| 832,921 | 4/1960 | United Kingdom | 240/78 H |

*Primary Examiner*—Edna M. O'Connor
*Attorney, Agent, or Firm*—Harvey S. Hertz

[57] ABSTRACT

A recessed lighting fixture which can be mounted in a wall or ceiling and requires a minimal opening for insertion. After the lighting fixture has been secured in the opening, normally no plastering or refinishing is required. A plurality of fasteners are positioned on the interior of the fixture housing. The fasteners are each mounted on a screw. A slot enables each of the fasteners to be rotated to the exterior surface of the housing after the lighting fixture has been positioned in the ceiling. The length of each fastener is greater than that of its corresponding slot. When the screw is rotated the securing member is positioned on the exterior of the lighting fixture housing. Further rotation of the screw causes the fastener to move to a position where it is adjacent the top surface of the ceiling and the lighting fixture is premanently secured to the structure.

3 Claims, 4 Drawing Figures

RECESSED LIGHTING FIXTURE

This is a continuation of application Ser. No. 458,932, filed Apr. 8, 1974, now abandoned.

BACKGROUND OF THE INVENTION

1. Field of the invention

The field of art to which the invention pertains includes the field of lighting fixtures, particularly with respect to a recessed lighting fixture which can be easily mounted in an existing structure.

2. Description of the prior art

Conventional lighting fixtures, which are mounted in existing facilities, have required that an opening be formed in the sheetrock or other ceiling or wall material. The recessed lighting fixture is then positioned in the wall surface and the space between the light fixture and the opening must then be replastered. Such an arrangement typically requires an electrician for mounting the lighting fixture and then a plasterer for refinishing and painting.

Certain lighting fixtures have been made which can be secured directly to the wall surface after an opening has been formed. However, these lighting fixtures normally have tapered or trapezoidally shaped housings enabling the securing members to be positioned adjacent the outer surface of the housing. Then the securing member is moved or rotated so that the lighting fixture can be secured to the ceiling or wall.

In those instances where the housing side walls are formed perpendicular to the ceiling or wall, a minimum of space is available on the exterior surface of the lighting fixture for positioning the securing member adjacent the housing outer surface. Should the securing member be positioned adjacent the outer surface, a large opening would have to be formed in the wall or ceiling which would require further replastering after the lighting fixture has been secured.

Known prior art includes U.S. Pat. Nos. 3,018,082; 2,305,015; 2,966,325; 2,954,959; 3,319,919; 2,744,716; and Canadian Pat. No. 484,226.

The present invention provides a securing member which can be mounted on a lighting fixture housing with a minimum size opening in the wall structure. After the recessed lighting fixture has been positioned in an opening, self-contained securing means fastens the housing to the ceiling or wall member. No replastering is required due to the minimal size opening.

SUMMARY OF THE INVENTION

A recessed lighting fixture which can be mounted in a ceiling or wall without the necessity of replastering or painting once the lighting has been secured. A securing member is positioned on the interior or the lighting fixture housing. The fastener is rotated to the exterior of the housing member and then positioned adjacent the interior surface of the ceiling or wall member.

The advantages of this invention, both as to its construction and mode of operation, will be readily appreciated as the same becomes better understood by reference to the following detailed description when considered in connection with the accompanying drawings in which like reference numerals designate like parts throughout the Figures.

DESCRIPTION OF THE PREFERRED EMBODIMENTS

Figure 1:
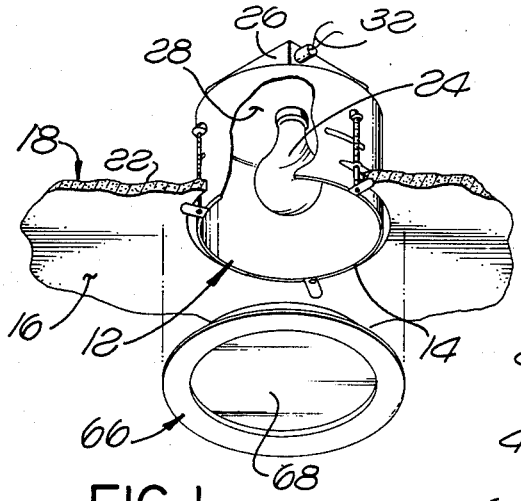
FIG. 1 is a perspective view, partially broken away, illustrating the interior portion of the lighting fixture.

Referring now to the drawings there is shown in FIG. 1 a recessed lighting fixture constructed in accordance with principles of the invention. The lighting fixture 12 is illustrated as being mounted so that its front end 14 is generally flush with the room side surface 16 of a wall or ceiling member 18. The wall or ceiling member is typically made of sheetrock or similar material and also contains an interior side surface 22.

The lighting fixture normally contains a light bulb 24 illustrated as an incandescent lamp although it should be understood that a photo-flood lamp could be used as well, as is conventional. The light bulb 24 is secured into an electrical junction box 26 mounted on the end wall 28 outer surface of the lighting fixture housing. Electrical wires 32 are used to interconnect the junction box 26 to a source of electrical power (not shown). A cylindrical side wall 34 extends from the end wall 28 of the lighting fixture and terminates at the front end 14 of the lighting fixture. While the housing has been shown as being of the circular fashion configured from a cylindrical side wall 34 it should be understood by those familiar with lighting fixtures that rectangular or other shaped lighting fixtures could be used with the invention as well.

Figure 2:
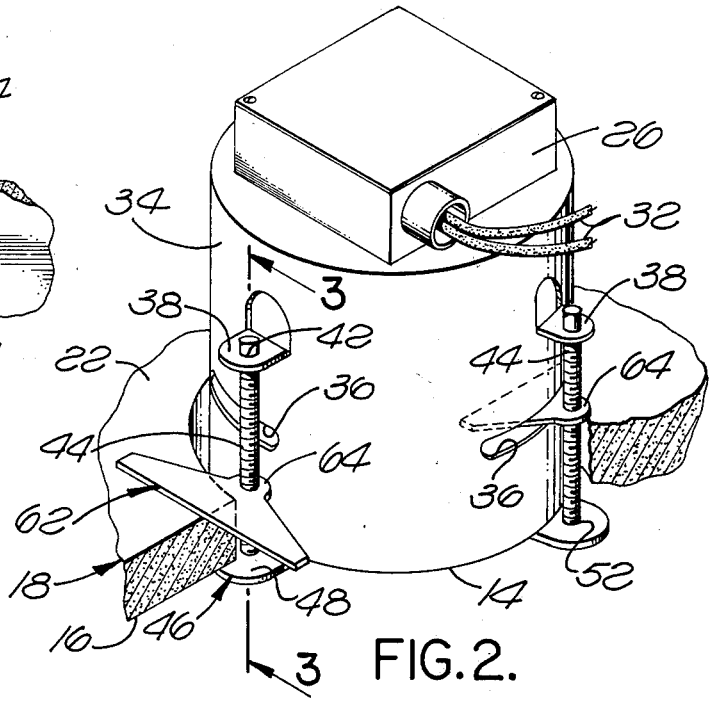
FIG. 2 is a perspective view of the exterior of the lighting fixture of FIG. 1.
Figure 3:
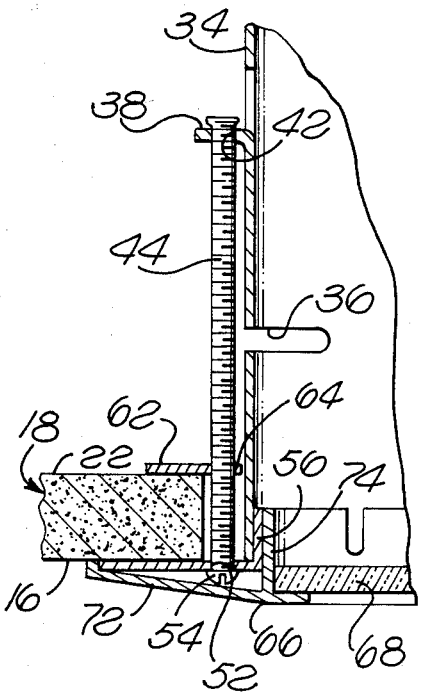
FIG. 3 is a partial side view, in section, of the lighting fixture taken along the line 3–3 of FIG. 2.

Three equally spaced slots 36, (two of which are shown in FIG. 2) are positioned approximately one-third the distance from the front end 14 of the lighting fixture in a plane parallel to the end wall 28 of the lighting fixture housing. Positioned adjacent each of these slots and intermediate the end wall 28 and the slots, are a plurality of tabs 38 each of which may be punched or otherwise stamped from the housing. The tabs 38 are bent to extend from the exterior surface of the side wall 34 in a plane parallel to the plane of the slots 36 and the end wall 28. Each tab contains a circular opening 42 through which one end of a screw 44 passes. The other end of the screw 44 is positioned through L-shaped mounting brackets 46 whose support surface 48 extend outwardly from the housing in a plane parallel to the tab 38. As can be seen in FIG. 3, an opening 52 in the support surface 48 enables the screw to pass through the support surface 48 and the head of the screw 54 rests adjacent the room side of the support surface. The mounting brackets 46 also contain a securing portion 56 which is juxtaposed with the interior surface of the housing side wall 34. In addition, the end of the screw 44, which passes through the tabs 38 is enlarged slightly so that the screw cannot drop through the tab opening 42.

Figure 4:
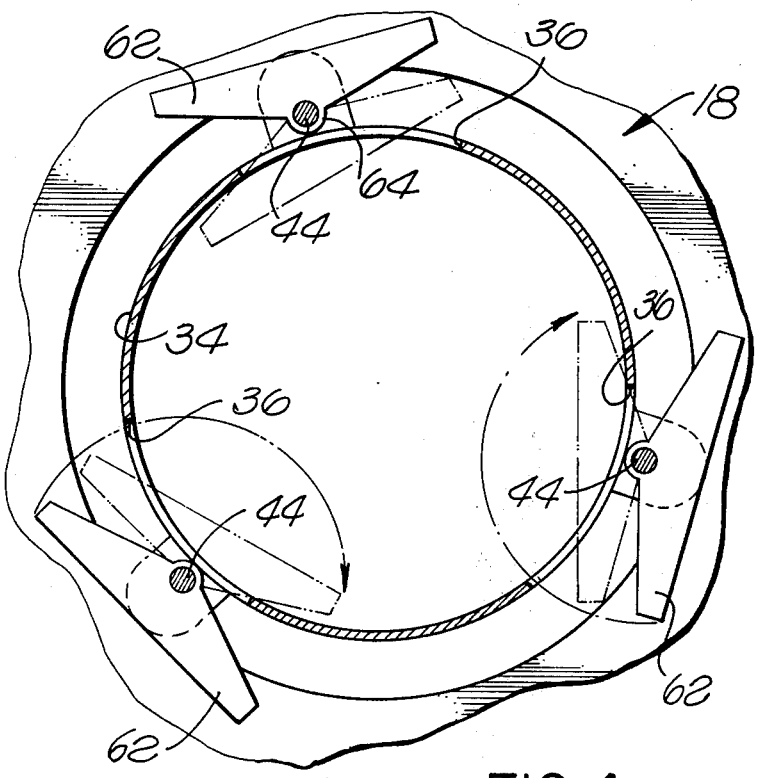
FIG. 4 is a bottom view of the lighting fixture used to explain the mechanism for securing the lighting fixture to a wall or ceiling member.

A plurality of elongated fasteners 62 contain an enlarged central portion 64 and are secured to each of the screws 44. The elongated fasteners 62 are formed in a plane parallel to the slots 36. As can be seen in FIG. 4 the screws 44 are offset with respect to the mid-point of the slots 36. Additionally, the thickness of the fasteners 62 are such that they can pass through the slots 36. The slots however, have a length less than the length of the fasteners 62 enabling the fasteners to be rotated into the interior of the housing during installation. However, as can be seen in FIG. 4, a portion of the fasteners will protrude to the exterior of the cylindrical housing.

Referring again to FIG. 2, during installation of the lighting fixture 12, an opening is cut into the wall or ceiling member 18 sufficient so that the protruding portion of the fastener 62 and the tab 38 can pass from the room side of the wall member 18 to the interior side thereof. However, the opening is made so that the support surface 48 of the L-shaped mounting members 46 abut the room side 16 of the wall member 18. Then each of the screws 44 are rotated (by means of a screwdriver) so that the elongated fasteners 62 rotate through the slots 36 and are positioned on the exterior surface of the cylindrical side wall 34 of the lighting fixture 12. Further rotation of the screw 44 causes one edge of the elongated fasteners to abut the outer surface of the cylindrical side wall 34. Continued rotation of the screw causes the elongated fasteners to move downwardly along the axis of the screw until the fasteners abut the interior side 22 of the wall member. When all three elongated fasteners have been positioned so that they are abutting the interior side of the wall members, the lighting fixture is secure.

Then an ornamental cover member 66 having a glass central member 68 is positioned so that its outer flange 72 covers the support surface 48 of each of the L-shaped mounting brackets 46. A cylindrical interior portion 74 of the cover member 66 is recessed into the lighting fixture housing so that it abuts the securing portion 56 of the L-shaped mounting members 46. Spring clips can also be used to secure the cover member 66 to the housing as is conventional. Thus, as can be readily seen, a recessed lighting fixture can be easily mounted in a room without the necessity for further replastering once the lighting fixture has been mounted on the wall and is secured thereto.

I claim:

1. Apparatus for mounting a recessed lighting fixture to a wall member having a first side which defines a room surface and a second side which defines an interior surface comprising:

a lighting fixture housing having a side wall, said side wall having an inner surface and an outer surface;

a first generally planar tab member and a second generally planar tab member having surfaces spaced apart in parallel planes intersected by said side wall and secured to said lighting fixture housing;

a slot formed in said housing side wall in a plane parallel to the planes of said surfaces of said tab member;

a positioning means secured between said tab members and having a generally planar fastener secured thereto, said fastener being mounted in a plane perpendicular to said surface of said side wall, said positioning means being rotatable to move said fastener from the interior of said housing adjacent to the outer surface of said housing wall through said housing wall slot and for positioning said fastener adjacent said second tab member, the length of said fastener being greater than the length of said slot.

2. Apparatus in accordance with claim 1 wherein said positioning means for said fastener includes a rotatable screw.

3. Apparatus in accordance with claim 2 wherein said second tab member is spaced from said fastener when a wall member is secured between said fastener and said second tab member.

* * * * *